US010335748B2

(12) United States Patent
Frei et al.

(10) Patent No.: US 10,335,748 B2
(45) Date of Patent: Jul. 2, 2019

(54) STIRRING DEVICE AND LABORATORY DEVICE WITH SUCH A STIRRING DEVICE

(71) Applicant: IKA—WERKE GMBH & CO. KG, Staufen (DE)

(72) Inventors: Andreas Frei, Staufen (DE); Hubert Pinhack, Bad Krozingen (DE); Philip Doebele, Freiburg (DE)

(73) Assignee: IKA—WERKE GMBH & CO. KG, Staufen (DE)

( * ) Notice: Subject to any disclaimer, the term of this patent is extended or adjusted under 35 U.S.C. 154(b) by 161 days.

(21) Appl. No.: 15/315,625

(22) PCT Filed: Jun. 3, 2015

(86) PCT No.: PCT/EP2015/001133
§ 371 (c)(1),
(2) Date: Dec. 1, 2016

(87) PCT Pub. No.: WO2015/185216
PCT Pub. Date: Dec. 10, 2015

(65) Prior Publication Data

US 2018/0185797 A1 Jul. 5, 2018

(30) Foreign Application Priority Data

Jun. 5, 2014 (DE) ..... 10 2014 008 371

(51) Int. Cl.
*B01F 7/00* (2006.01)
*B01F 13/00* (2006.01)
*B01F 15/00* (2006.01)

(52) U.S. Cl.
CPC ..... *B01F 7/00733* (2013.01); *B01F 13/005* (2013.01); *B01F 13/0033* (2013.01); *B01F 15/00266* (2013.01); *B01F 15/00519* (2013.01); *B01F 2215/0037* (2013.01)

(58) Field of Classification Search
CPC ..... B01F 13/0033; B01F 13/005; B01F 15/0266; B01F 15/00519; B01F 2215/0037
See application file for complete search history.

(56) References Cited

FOREIGN PATENT DOCUMENTS

| | | |
|---|---|---|
| DE | 42 36 217 C1 | 12/1993 |
| WO | 2013036186 A1 | 3/2013 |

OTHER PUBLICATIONS

WO2013/036186 to Axelsson (Year: 2013).*
WO2013/036186 to Axelsson Published Mar. 14, 2013. (Year: 2013).*

* cited by examiner

*Primary Examiner* — Anshu Bhatia
(74) *Attorney, Agent, or Firm* — Budzyn IP Law, LLC

(57) ABSTRACT

The invention relates to a stirring device (1) which has at least one stirring element (4) which is driven by a stirring drive (2), contacts a stirring medium (3) in the use position, can be moved relative to the stirring drive (2) and to the stirring medium (3), and can be at least partly immersed into the stirring medium (3) in the use position. The invention is characterized in that stirring drive (2) is arranged in the interior of the stirring element (4). The stirring device (1) is and/or can be supported by the stirring medium (3), in particular without a holder and/or without a stand, whereby a separate mounting, a stand for a stirring element and/or for a stirring drive, and/or a stirring drive housing can be omitted.

28 Claims, 2 Drawing Sheets

STIRRING DEVICE AND LABORATORY DEVICE WITH SUCH A STIRRING DEVICE

Figure 1:
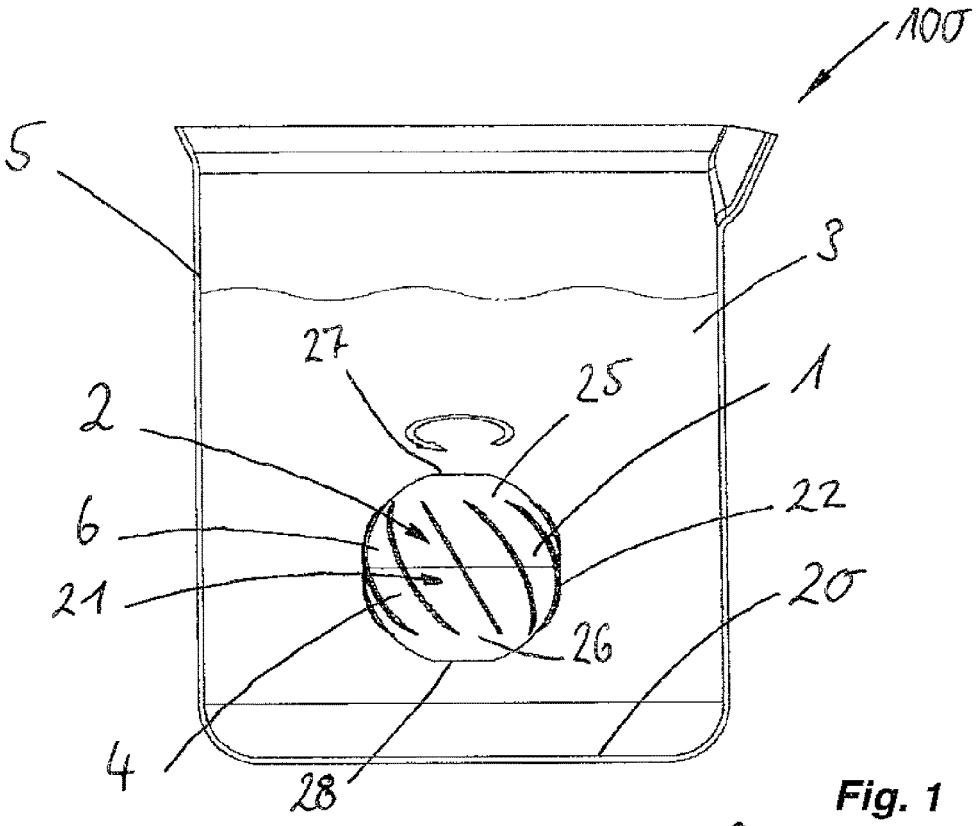

The invention relates to a stirring device which has at least one stirring element, which is driven by a stirring drive, contacts a stirring medium in the use position, is moveable relative to the stirring drive and to the stirring medium, and is at least partially immersible into the stirring medium in the use position.

The invention additionally also relates to laboratory equipment with at least one such stirring device.

Stirring devices of this type and also laboratory equipment with such stirring devices are known in multiple forms, wherein, in general, a stationary, external drive supports a stirring shaft and a stirring tool arranged on the same. Thus, for example, overhead stirrers are known which have a stand on which such a drive is provided for a stirring shaft and a stirring element arranged thereon.

In addition, magnetic stirrers are also known, in which the actual stirring element is not mechanically connected to the drive, but instead may be driven via a magnetic coupling.

In all of these cases, however, a stand is required for supporting the stirring element and/or the stirring drive and the housing thereof. The spatial requirements of these types of stirring devices may be comparatively high.

It is therefore the object of the invention to create a stirring device of the type listed at the outset and laboratory equipment with the same, which have the smallest spatial requirements.

According to the invention, this problem is solved in the case of the stirring device by the features of Patent claim 1 and, in particular, in that the stirring drive is arranged in the interior of the stirring element.

In this way, the stirring drive of the stirring device may be integrated into the stirring element, by which means a stand may be omitted for the stirring drive, and a stirring drive with an autonomous housing separate from the stirring element may be omitted. Thus, the spatial requirements necessary for the stirring device may be reduced.

It may thereby be particularly advantageous, if the stirring device is supported and/or supportable by and/or through the stirring medium, in particular without a holder and/or without a stand. It is thus possible that the stirring device is itself supported by the stirring medium to be processed using the stirring device, thus a holder or a stand, on which the stirring drive and the stirring element are also generally arranged in the case of stirring devices previously known from the prior art, may be omitted. The user of the stirring device then needs only to insert the same into the stirring medium and requires no additional space for a stirring drive located outside of the medium.

It may be particularly advantageous if the stirring element has a stirring element housing and/or the stirring drive has a stirring drive housing which is arranged in the use position in the stirring element housing of the stirring element, wherein the stirring element housing and the stirring drive housing are movable relative to one another. In this way, the stirring drive arranged in the interior of the stirring element housing may act from inside on the stirring element housing in order to move the stirring element housing with respect to the stirring drive or with respect to the stirring drive housing thereof, in order to ultimately process the stirring medium, in which the stirring device, comprising the stirring element, the stirring element housing, the stirring drive with the stirring drive housing thereof arranged in the interior of the stirring element housing, is placed in the use position in the desired way with the aid of the stirring element.

The stirring element housing may preferably be designed as multipart, in particular as two parts, and may have an upper and a lower housing half.

It may thereby be advisable if the stirring element and/or the stirring element housing has at least one stirring tool arranged on the outer side thereof, with which the stirring medium may be processed.

In one particularly advantageous embodiment of the invention, the stirring device may have a stabilizing device with at least one stabilizing element. The stabilizing device and/or the at least one stabilizing element may then additionally function to inhibit and/or indeed completely prevent a movement of the stirring drive and/or the stirring drive housing, by which means a relative movability between the stirring element and the stirring drive may be enabled.

The stabilizing device may thereby have a flywheel and/or a stabilizing weight arranged eccentrically on the stirring drive and/or on a, for example, the already previously mentioned stirring drive housing, as at least one stabilizing element.

With the aid of a stabilizing weight, which may preferably be arranged eccentrically on the stirring drive housing, the stirring drive housing may be stabilized due to the gravity acting on the stabilizing weight and may be held with respect to the stirring element.

The stirring drive of the stirring device may thereby be appropriately designed as an electric drive.

In addition, the stirring device may also have, in addition to the stirring drive, a stabilizing drive with which at least a, for example, the already previously mentioned at least one stabilizing element, in particular a, for example, the already previously mentioned flywheel, is drivable.

The stabilizing drive may thereby set the at least one stabilizing element, in particular the flywheel, into rotation in order to bring about a stabilization of the stirring device in the use position thereof.

The drivable flywheel may be used as a stabilizing element of the stabilizing device in order to stabilize or hold the stirring device, and, in particular, the stirring drive and/or the drive housing thereof, with respect to the stirring element and/or the stirring element housing, by using the gyroscopic effect, which may act on the stirring device due to the flywheel set into rotation by means of the stabilizing drive, and thus in order to enable and/or to facilitate a relative movability between the stirring element and the stirring drive.

It may be particularly appropriate if the stirring device has at least one electric power source which is connected in the use position to the electrical supply of the stirring drive and/or a, for example, the already previously mentioned stabilizing drive or is connectable to the same. This electric power source may appropriately be a battery and/or a rechargeable accumulator.

It is further possible that the electric power source for electrical supply of the stirring drive and/or the stabilizing drive is inductively chargeable. The power source may thereby be arranged, for example, in the stirring drive housing and/or recharged in a non-contact manner and/or wirelessly as soon as the discharge state thereof no longer allows for further operation of the stirring device.

The stirring drive may be, for example, a geared motor, the drive thereof is connected on an inner side of the stirring element via a coupling or rigidly to the stirring element and/or to a, for example, the already previously mentioned stirring element housing. It is, however, also possible that at least one drive element, which is drivable using the stirring drive and acts in a positive locking or friction locking way on the stirring element, is provided between the stirring element and/or the stirring element housing and the stirring drive and/or a, for example, the already previously mentioned stirring drive housing. The drive element may additionally be used to establish the relative movement between the stirring drive and the stirring element.

As the stirring device is preferably inserted into liquid stirring media, a, for example, the already previously mentioned stirring element housing may be sealed closed, in particular, may be closable liquid tight.

To carry out maintenance and/or repairs on the stirring device, it is possible that the stirring element housing is reversibly openable and/or reclosably sealed, in particular, liquid tight, by means of a seal.

In another embodiment of the invention, it may be provided that the stirring device, has an, in particular, liquid-tight closable electric charging contact on a, for example, the already previously mentioned stirring element housing, and the electric charging contact is connected to a, for example, the already previously mentioned power source for electrical supply of the stirring drive and/or of a, in particular, the already previously mentioned stabilizing drive. The charging contact may thereby be preferably designed as a plug socket.

It is additionally possible that the stirring device has a charging device equipped for contactless electrical charging, which in the use position is connected or is connectable to a, for example, the already previously mentioned electrical power source of the stirring device. This charging device equipped for contactless electrical charging may thereby be arranged preferably on the stirring drive and/or on the stirring drive housing. This electrical charging device may appropriately be designed as a charging coil.

A particularly good stabilizing of the stirring drive with respect to the stirring element and the stirring device immersed at least partially into the stirring medium in the use position thereof may be achieved if the stirring device has multiple, in particular two or three flywheels as stabilizing elements, the rotational axes thereof are preferably aligned at an angle to one another.

In one embodiment of the stirring device according to the invention, a rotational axis of the stirring drive and/or the stirring drive housing and/or the stirring element and/or the stirring element housing is aligned horizontally, and vertically in another embodiment of the stirring device.

By using flywheels as stabilizing elements, this may primarily function and assist in aligning a rotational axis of the stirring element and/or the stirring element housing as vertical or virtually vertical.

It may additionally be particularly appropriate, if a rotational axis of at least one or the already previously mentioned at least one stabilizing element, designed in particular as a flywheel, is transverse or at right angles to a rotational axis of a rotational movement and/or stirring movement of the stirring element and/or a, for example, the already previously mentioned stirring element housing.

In order that the stirring device may be suspended in the stirring medium in the use position immersed at least partially into the stirring medium, thus in the use position either floats on the top or sinks therein down to a bottom of a stirring container or container accommodating the stirring device, it may be appropriate if a total weight of the stirring device is at least as great as a weight of an amount of the stirring medium displaced by the stirring device completely immersed in the stirring medium. In this way, the stirring device may indeed be completely immersed in the stirring medium; however, the stirring device is then not so heavy that it would sink to the bottom of the stirring container.

A processing of the stirring medium may be carried out particularly reliably and thoroughly if the stirring element has at least one stirring tool, in particular on the outer side or on an outer side of the stirring element housing. This at least one stirring tool may thereby preferably be an external projection and/or a blade and/or a stud oriented in particular transverse to a rotational axis of the stirring element.

If a sum of a static drive force and a dynamic drive force, caused by the movement of the stirring element and/or a, for example, the already previously mentioned at least one stirring tool, is at most as great as a weight force acting on the stirring device in the use position, it may be possible that the stirring device floats or even is suspended in the stirring medium in the use position thereof immersed at least partially into the stirring medium, thus does not sink to a bottom of a stirring container.

Based on stirring technology, it may be particularly advantageous if the stirring element housing of the stirring device is designed as spherical or egg-shaped or cylindrical. Primarily in a spherical configuration of the stirring element housing, the stirring element may then relatively precisely assume a desired position, in particular with the aid of the at least one stabilizing element, preferably designed as a flywheel, and externally act reliably on the stirring medium to be processed using corresponding stirring tools or stirring projections.

In addition, a spherical configuration of the stirring element housing may be particularly advantageous for a space-saving integration of the at least one stabilizing element of the stabilizing device designed in particular as a flywheel.

To store a spherical stirring device, it may be particularly appropriate if the stirring device and/or the stirring element housing has at least one, preferably two flattened areas arranged on opposite sides of the stirring device and/or the stirring element housing, by means of which the stirring device may be securely deposited and stored on a flat surface.

If the stirring device has at least one transmitter and/or receiver for wireless exchange of data and/or control commands, which is preferably wirelessly linkable at least temporarily to an external control and/or programming device, then the stirring device may be conveniently controlled and operated by a user of the stirring device. It is also possible that the stirring device, if it has at least one transmitter and/or receiver for wireless exchange of data and/or control commands, is also wirelessly linkable at least temporarily to a second such stirring device. In this way, two or three of this type of stirring devices, or, however, also multiple such stirring devices, may be simultaneously operated in a common container and also primarily coordinated with one another.

The coupling of such stirring devices among one another may also be appropriate if each of the stirring devices is placed in its own stirring container. It is thus, for example, conceivable that a plurality of such stirring devices, which are each placed in their own stirring container for processing a stirring medium, may be programmed, controlled, and ultimately also operated with the aid of one common external control and/or programming device.

The wireless exchange between transmitters and/or receivers of the stirring device(s) and/or the external control and/or programming device is thereby appropriately carried out via radio.

In addition to the previously described transmitter and/or receiver, the stirring device may naturally also have the electronic control and/or storage elements necessary and known in and of themselves for operation, control, and/or programming.

The problem is thereby solved for the laboratory equipment defined at the outset by the features of Patent claim 21 and in particular in that the laboratory equipment is equipped with at least one stirring device according to one of Patent claims 1 through 20 and with at least one container for accommodating a stirring medium and the at least one stirring device.

Advantageous embodiments of the inventions arise from a combination of the features treated in the patent claims, however also from features which are mentioned only in the description or in the description of the figures or in the figures.

An embodiment of the invention is subsequently explained in greater detail by way of the drawings. The figures are shown in sometimes strongly schematic representation.

Figure 2:
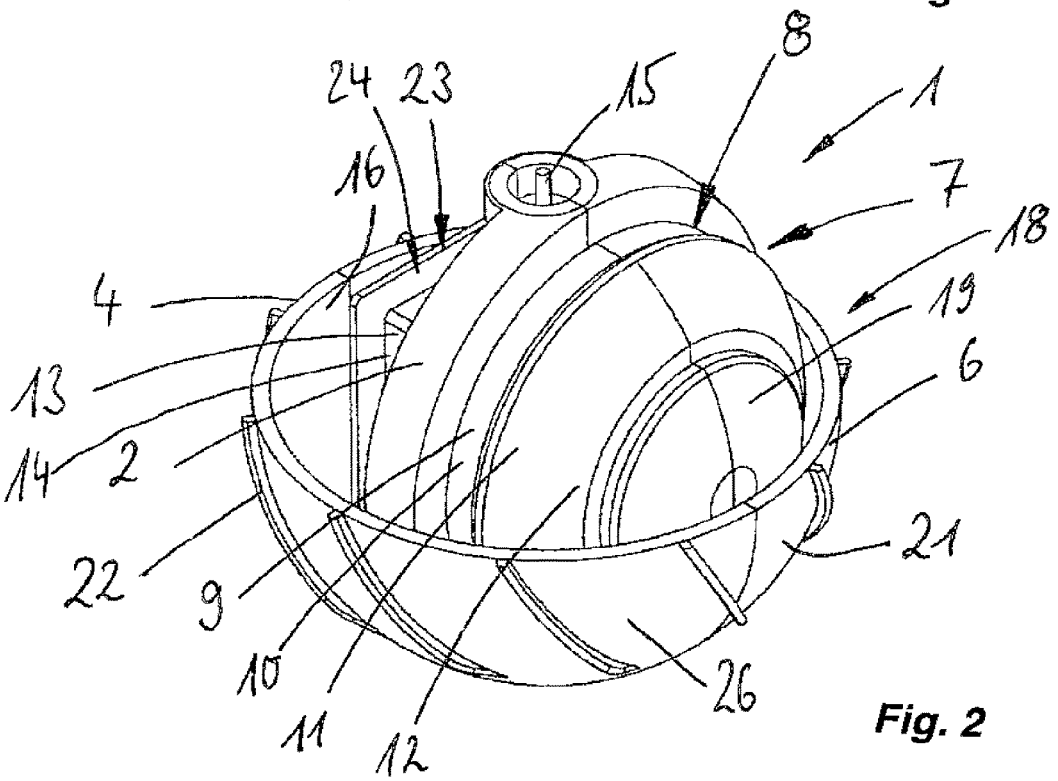
Figure 3:
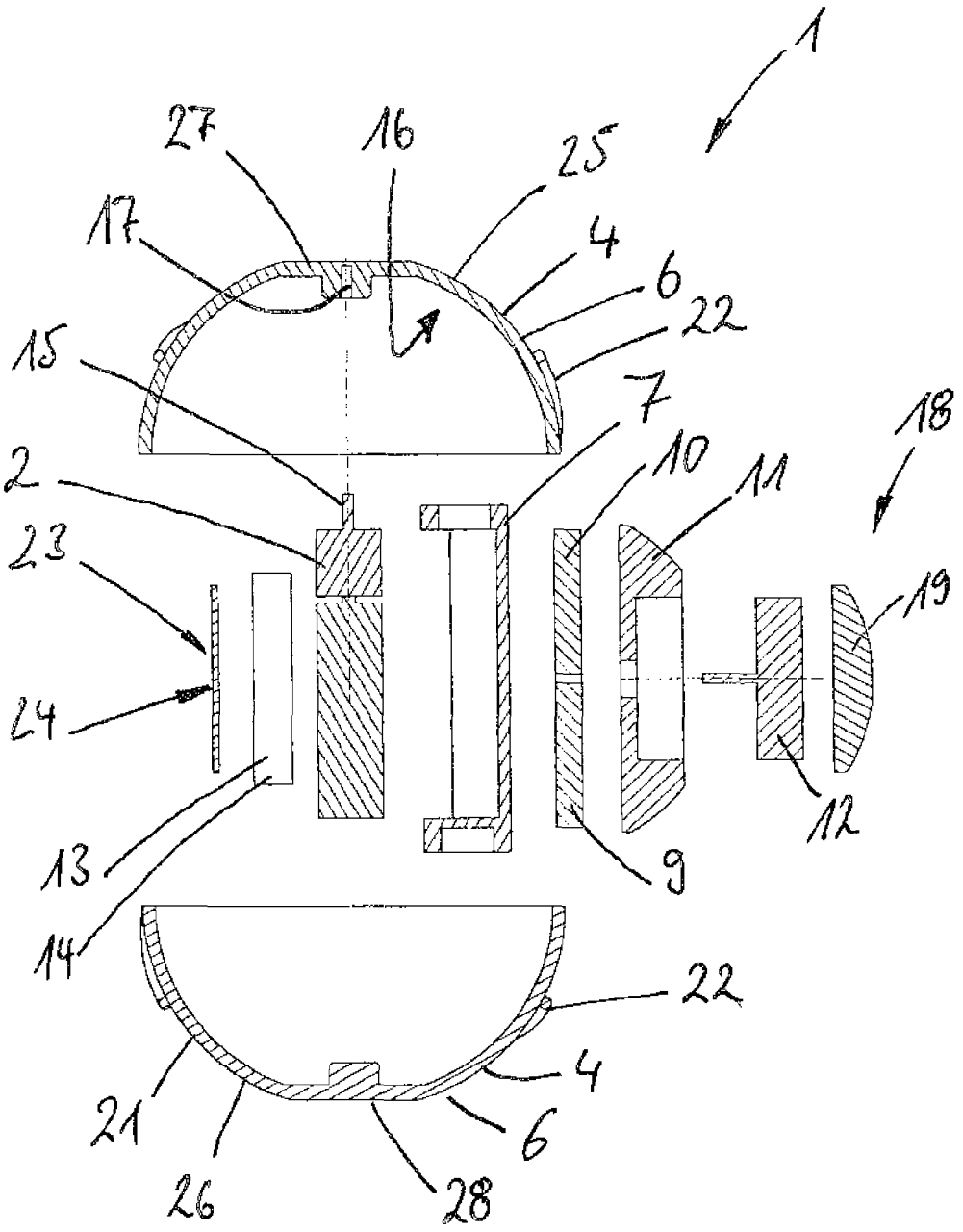

FIG. 1: shows a side view of a stirring device according to the invention in the use position thereof positioned in a stirring container or a container, wherein it is clear that the stirring device is suspended above the bottom of the stirring container in the stirring medium, FIG. 2: shows a perspective side view of the stirring device according to the invention shown in the use position thereof according to FIG. 1, wherein only a lower half of a stirring element housing of the stirring element of the stirring device and a stirring drive housing of a stirring drive of the stirring device placed therein are clear, whereas an upper half of the stirring element housing is removed for a better overview, and FIG. 3: shows a cutaway exploded representation of the stirring device according to the invention shown in FIGS. 1 and 2, wherein a stirring drive, a holder for the stirring drive, a stabilizing element designed as a fly wheel, a weight, a stabilizing drive, a charging coil, and an accumulator as a power source on the other side of the stirring drive, and also an electronic component for the stirring drive, and the elements connected to the stirring drive, are clear when viewed from the inside to the outside.

A stirring device, designated as a whole as 1, has at least one stirring element 4, which is driven by a stirring drive 2, contacts a stirring medium 3 in the use position, is moveable relative to stirring drive 2 and to stirring medium 3, and is at least partially immersible into stirring medium 3 in the use position.

Stirring device 1 is characterized in that stirring drive 2 is arranged in the interior of stirring element 4.

It is clear from FIG. 1, that stirring device 1 is supported without a holder and without a stand by or through stirring medium 3. Thus, this stirring device 1 does not require stands, legs, holders, or other elements positioned outside of a container or stirring container 5 functioning to accommodate stirring medium 3. A separate stirring drive housing positioned outside of the stirring drive accommodating the housing of the stirring drive, may also be omitted.

Stirring element 4 has a stirring element housing 6, whereas stirring drive 2 is provided with a stirring drive housing 7. Stirring drive housing 7 with stirring drive 2 is arranged in stirring element housing 6 in the use position according to FIGS. 2 and 3, wherein stirring element housing 6 and stirring drive housing 7 are movable relative to one another.

Stirring device 1 is additionally equipped with a stabilizing device 8 which has at least one stabilizing element 9. Stabilizing device 8 and stabilizing element 9 limit or prevent a movement of stirring drive 2 and/or of stirring drive housing 7 with respect to stirring element 4 and thus enable a relative movability between stirring element 4 and stirring drive 2.

Stabilizing device 8 has a flywheel 10 as the at least one stabilizing element 9. In addition, stirring device 1 is provided with a stabilizing weight 11 arranged eccentrically on stirring drive 2 or on stirring drive housing 7. Stabilizing weight 11 enables, together with flywheel 10, stirring device 1 to be able to adopt a stable position in the use position thereof immersed at least partially in stirring medium 3, even if stirring drive 2 sets stirring element 4 of stirring device 1 into motion or rotation with respect to the stirring drive.

Stirring drive 2 of the stirring device shown in the figures is an electric drive.

Stirring device 1 has, in addition to stirring drive 2, a stabilizing drive 12, with which stabilizing element 9, thus flywheel 10, is drivable for stabilizing the position of stirring device 1 in stirring medium 3 in the use position. Stabilizing drive 12 thereby sets flywheel 10 into rotation such that it acts in a stabilizing way on stirring device 1 by using the gyroscopic effect.

FIG. 3 shows in particular that stirring device 1 has an electric power source 13. This electric power source 13 is designed as a rechargeable accumulator in the embodiment of stirring device 1 shown in the figures; however, it may also be designed as a preferably exchangeable battery in embodiments of stirring device 1 (not shown).

Electric power source 13 functions for electric supply of stirring drive 2 and also of stabilizing drive 12. Electric power source 13 is connected in the use position with the stirring drive and the stabilizing drive for this purpose. In addition, stirring device 1 or electric power source 13 is inductively chargeable, in particular when the latter is designed as accumulator 14.

Stirring drive 2 of stirring device 1 is a motor, in particular a geared motor, the drive 15 or drive shaft thereof is connected on an inner side 16 of stirring element 4 or of stirring element housing 6 via a coupling or rigidly to stirring element housing 6 of stirring element 4.

In the embodiment of the stirring device shown in the figures, drive 15 or the drive shaft of stirring drive 2 is inserted into a recess 17, which functions as a coupling, on inner side 16 of stirring element 4 or of stirring element housing 6 in the use position.

In an embodiment of stirring device 1 (not shown in the figures), at least one drive element, acting in positively locking or friction locking way on stirring element 4, drivable using stirring drive 2, is provided between stirring element 4 and stirring drive 2, in particular between stirring element housing 6 and stirring drive 2 or stirring drive housing 7.

Stirring element housing 6 is sealed, in the meaning of liquid-tight, closable and closed in the use position in order to protect the elements of stirring device 1 arranged in the interior of stirring element housing 6 from moisture. In order to access the elements arranged in stirring element housing 6, for example for maintenance purposes, stirring element housing 6 is reversibly openable and closable again liquid-tight by means of a seal (not shown in the figures).

Stirring element housing 6 is designed as two parts and has an upper housing half 25 and a lower housing half 26 which are connected to one another in the use position such that stirring element housing 6 is sealed closed. Both housing halves 25 and 26 are provided on an upper side or on a lower side thereof with flattened areas 27 and 28 through which the rotational axis of stirring drive 2 and stirring element 4 extends in the use position. Flattened areas 27 and 28 enable stirring device 1 to be securely deposited on a surface in the non-use position so that stirring device 1 does not roll away.

In one embodiment of stirring device 1 (not shown in the figures), stirring device 1 has a liquid-tight sealable electric charging contact, which is preferably designed as a plug socket, on stirring element housing 6. This charging contact is connected to power source 13 for electrical supply of stirring drive 2 and stabilizing drive 12.

Stirring device 1 shown in the figures has for this purpose a charging device 18 with a charging coil 19, designed for contactless electrical charging, which is connected to electrical power source 13 of stirring device 1 in the use position. This means that accumulator 14, which forms power source 13 in stirring device 1 shown in the figures, may be recharged by means of charging coil 19 of charging device 8 as needed.

In one embodiment of stirring device 1 (not shown in the figures) it is provided that it has two or three or more stabilizing elements 9 as flywheels 10, the rotational axes thereof are designed preferably at an angle to one another in order to provide stirring device 1 with yet more stability in the use position thereof immersed at least partially into stirring medium 3.

In stirring device 1 shown in the figures, a rotational axis of stirring drive 2 and of stirring drive housing 7 and of stirring element 4 and stirring element housing 6 thereof is designed as vertical, as is visible in FIG. 1.

In one embodiment of stirring device 1 (not shown in the figures), a rotational axis of stirring drive 2 and of stirring drive housing 7 and of stirring element 4 and stirring element housing 6 thereof is designed as horizontal.

In the stirring device shown in the figures, a rotational axis of stabilizing element 9 designed as flywheel 10 is aligned transverse to the rotational axis of stirring drive 2, thus horizontal in the use position and thus at right angles to the rotational axis of stirring drive 2 and of stirring drive housing 7 and of stirring element 4 and of stirring element housing 6 thereof.

In one embodiment of stirring device 1 (not shown in the figures), the rotational axis of stabilizing element 9 may, however, also be designed as vertical.

The total weight of stirring device 1 is thereby at least as great as a weight of an amount of stirring medium 3 displaced by stirring device 1 completely immersed into stirring medium 3. It is thus possible that this stirring device, as shown in FIG. 1, is suspended in stirring medium 3 in the use position without contacting a bottom 20 of stirring container 5. The buoyancy of stirring medium 3 affecting stirring device 1 thus corresponds in amount to the weight force acting on stirring device 1, by which means stirring device 1 is held in suspension. This enables that stirring device 1 completely immerses in stirring medium 3 and is completely surrounded by stirring medium 3 in the use position, by which means stirring medium 3 may be reliably processed by stirring device 1.

Stirring device 1 has an external circumferential projection 22 on an outer side 21 of stirring element 4 or of stirring element housing 6 as a stirring tool, which may be aligned transverse to a rotational axis of stirring element 4, and with which stirring medium 3 may be displaced and thus processed, thus in particular, mixed through.

In order that stirring device 1 does not also float up or only to a small extent during operation thereof, thus while stirring element 4 rotates, a sum of a static drive force and a dynamic drive force, caused by the movement of stirring element 4 or of the stirring tool, is at most as great as a weight force acting on stirring device 1 in the use position.

Stirring element housing 6 of stirring device 1 shown in the figures is designed as spherical and has the already previously described flattened areas 27 and 28 on the upper and lower sides thereof to enable a secure storage of stirring device 1 in the non-use position.

In other embodiments (not shown in the figures) stirring element housing 6 of stirring device 1 is designed as egg-shaped or also as cylindrical and may likewise be provided with corresponding flattened areas.

Stirring device 1 has a transmitter and receiver 23 for wireless exchange of data and/or control commands via radio, which is preferably wirelessly linkable at least temporarily to an external control and/or programming device (not shown in the figures) or also to a second stirring device 1.

This transmitter and receiver 23 for wireless exchange of data and/or control commands is arranged on a printed circuit board 24, on which necessary control and storage elements are also arranged for the operation, control, and programming of stirring device 1.

The composition, shown in FIG. 1, consisting of stirring device 1 and stirring container 5, which accommodates stirring device 1 in the use position and which functions as the container for accommodating a stirring medium 3, is designated as laboratory equipment 100.

Laboratory equipment 100 may thereby also comprise multiple containers or stirring containers 5 with stirring devices 1 positioned therein and, if necessary, also an already previously described control and/or programming device, with which individual or also groups of or all of stirring devices 1 assigned to laboratory equipment 100 may be controlled and/or evaluated by one user of laboratory equipment 100.

Stirring device 1, which has at least stirring element 4, driven by a stirring drive 2, contacting a stirring medium 3 in the use position, movable relative to stirring drive 2 and to stirring medium 3, and at least partially immersible in stirring medium 3 in the use position, is characterized in that stirring drive 2 is arranged in the interior of stirring element 4, wherein stirring device 1 is supportable and/or is supported by and/or through stirring medium 3, in particular without a holder and/or without a stand, whereby separate holders and/or stands for a stirring element and/or a stirring drive and/or a stirring drive housing may be omitted.

The invention claimed is:

1. A stirring device (1) for stirring a stirring medium (3), the stirring device (1) comprising at least one stirring element (4), driven by a stirring drive (2), movable relative to the stirring drive (2) and to the stirring medium (3), and at least partially immersible in stirring medium (3), so as to be in contact therewith, in a use position, wherein the stirring element (4) includes a stirring element housing (6) which is sealed close or closable in a liquid-tight manner, the stirring drive (2) being arranged in the interior of the stirring element (4).

2. The stirring device (1) according to claim 1, wherein the stirring device (1) is supported by the stirring medium (3) without a holder or a stand.

3. The stirring device (1) according to claim 1, wherein the stirring drive (2) has a stirring drive housing (7) which is arranged in the stirring element housing (6), wherein the stirring element housing (6) and the stirring drive housing (7) are moveable relative to one another.

4. The stirring device (1) according to claim 3, wherein the stirring device (1) has a stabilizing device (8), wherein the stabilizing device restricts movement of at least one of the stirring drive (2) and the stirring drive housing (7) to enable relative movability between the stirring element (4) and the stirring drive (2).

5. The stirring device (1) according to claim 4, wherein the stabilizing device (8) includes at least one of a flywheel (10) and a stabilizing weight (11) arranged eccentrically on at least one of the stirring drive (2) and the stirring drive housing (7).

6. The stirring device according to claim 1, wherein the stirring drive (2) is an electric drive.

7. The stirring device according to claim 1, wherein the stirring device (1) has a stabilizing drive with at least one stabilizing element (9).

8. The stirring device according to claim 1, wherein the stirring device (1) has at least one electrical power source (13) which is connected or connectable to the stirring drive (2) for electrical supply of the same.

9. The stirring device according to claim 1, wherein the stirring drive (2) is a geared motor, a drive of the geared motor being connected to an inner side (16) of the stirring element housing (6).

10. The stirring device according to claim 1, wherein the stirring element housing (6) is reversibly openable and sealably closable in a liquid-tight manner by means of a seal.

11. The stirring device (1) according to claim 8, wherein the stirring device (1) has a charging coil (15) equipped for contactless electrical charging, which is connected to the electrical power source (15) of the stirring device (1).

12. The stirring device (1) according to claim 7, wherein the stirring device (1) has a plurality of stabilizing elements (9), the rotational axes of the stabilization elements (9) being aligned at an angle to one another.

13. The stirring device (1) according to claim 1, wherein a rotational axis of the stirring drive (2) passes through a center of the stirring element housing (6).

14. The stirring device (1) according to claim 12, wherein a rotational axis of at least one of the stabilizing elements (9) passes through a center of the stirring element housing (6).

15. The stirring device according to claim 12, wherein a rotational axis of at least one of the stabilizing elements, is transverse to a rotational axis of the stirring drive (2).

16. The stirring device according to claim 1, wherein a total weight of the stirring device (1) is at least as great as a weight of an amount of the stirring medium (3) displaced by the stirring device (1) completely immersed into the stirring medium (3).

17. The stirring device according to claim 1, wherein the stirring element has, on the outer side of the stirring element housing, at least one external projection.

18. The stirring device according to claim 1, wherein a sum of a static drive force and a dynamic drive force caused by the movement of the stirring element (4) is at most as great as a weight force acting on the stirring device (1) in the use position.

19. The stirring device (1) according to claim 1, wherein the stirring element housing (6) has a shape selected from a group of consisting of spherical, egg-shaped, and cylindrical.

20. The stirring device (1) according to claim 1, wherein the stirring device (1) has at least one of a transmitter and a receiver (28) for wireless exchange of data with an external control.

21. Laboratory equipment comprising at least one stirring device according to claim 1 and comprising at least one container for accommodating the stirring medium (3) and the at least one stirring device (1).

22. The stirring device according to claim 7, wherein the stabilizing element (9) includes a flywheel (10).

23. The stirring device according to claim 7, wherein the stirring device (1) has at least one electrical power source which is connected or connectable to the stabilizing drive.

24. The stirring device according to claim 7, wherein the stirring device (1) has a charging coil equipped for contactless electrical charging, which is connected to the stabilizing drive.

25. The stirring device according to claim 8, wherein the power source is a battery.

26. The stirring device according to claim 8, wherein the power source is a rechargeable accumulator.

27. The stirring device according to claim 8, wherein the power source is inductively chargeable.

28. The stirring device according to claim 12, wherein the stabilizing elements (9) each include a flywheel.

* * * * *